US006417823B1

(12) United States Patent
Rilly

(10) Patent No.: US 6,417,823 B1
(45) Date of Patent: Jul. 9, 2002

(54) METHOD OF DRIVING A PLASMA SCREEN

(75) Inventor: Gérard Rilly, Unterkirnach (DE)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/454,987

(22) Filed: Dec. 3, 1999

(30) Foreign Application Priority Data

Dec. 8, 1998 (DE) ..... 198 56 436

(51) Int. Cl.[7] ..... G09G 3/28
(52) U.S. Cl. ..... 345/60; 345/68
(58) Field of Search ..... 345/60, 61, 62, 345/63, 65, 66, 67, 68, 204, 208, 210; 315/169.1, 169.2, 169.3, 169.4

(56) References Cited

U.S. PATENT DOCUMENTS 5,854,540 A * 12/1998 Matsumoto et al. ..... 345/204
6,124,849 A * 9/2000 Ito et al. ..... 345/204
6,252,568 B1 * 6/2001 Iseki et al. ..... 345/60

FOREIGN PATENT DOCUMENTS

| | | | |
|---|---|---|---|
| DE | 19744793 | 4/1998 | ..... G09G/3/20 |
| EP | 0444962 | 10/1994 | ..... G09G/3/28 |
| EP | 0774745 | 5/1997 | ..... G09G/3/28 |
| EP | 0807919 | 11/1997 | ..... G09G/3/28 |
| EP | 0833299 | 4/1998 | ..... G09G/3/28 |
| EP | 0887785 | 12/1998 | ..... G09G/3/28 |
| EP | 0890941 | 1/1999 | ..... G09G/3/28 |

* cited by examiner

*Primary Examiner*—Xiao Wu
(74) *Attorney, Agent, or Firm*—Joseph S. Tripoli; Harvey D. Fried; Sammy S. Henig

(57) ABSTRACT

The invention is based on the object of compressing time losses and of improving an enhanced picture display.

The method according to the invention of driving a plasma screen which is subdivided into horizontal lines and vertical pixel points, it being possible for the individual pixel points to be driven for different lengths of time, a preparation mode and an addressing mode being provided for driving, is distinguished by the fact that the lines are combined into groups and that, in the groups, the preparation mode and the addressing mode are executed separately, the preparation mode including a priming mode and an erasing mode.

12 Claims, 2 Drawing Sheets

METHOD OF DRIVING A PLASMA SCREEN

BACKGROUND OF THE INVENTION

1. Field of the Invention

The invention is based on a method of driving a plasma screen.

2. Description of the Related Art

It is known that, in the case of plasma screens, the individual plasma pixels are each driven individually in accordance with the picture content. This means that when there is a 16/9 picture present, and it contains 480 lines to be displayed, the division ratio results in a pixel number of 854 pixels per line if the pixel width is equal to the line height. In order to obtain a different luminous intensity in the case of a plasma screen, the plasma pixel has to be activated appropriately frequently. After such a plasma pixel has been activated, an extinguishing operation has to follow in order to make the plasma pixel dark. Given a division into 128 or 256 grey stages, that is to say 128 or 256 different luminous intensity values, at present the addressing of the picture is subdivided into so-called subfields.

Since the system is built up digitally, 8 subfields are used in the case of 256 grey stages. In the conventional method, in at 8 subfields in each case those pixel points which are needed to display different contours in a picture are addressed. This means that, in order to obtain a grey value of 256, the pixel point which is intended to reach this grey value must illuminate continuously, so that the value results from: subfield 1 equal to 1, subfield 2 equal to 2, subfield 3 equal to 4, subfield 4 equal to 8, subfield 5 equal to 16, subfield 6 equal to 32, subfield 7 equal to 64, subfield 8 equal to 128. This means that when the picture is displayed, each pixel point in each subfield would be addressed. If, for example, it is intended to reach a grey value of 64, this pixel point, which is to reach the grey value 64, is to be driven only in subfield 7. If a grey value of 72 is to be achieved, then the appropriate pixel point which is to achieve the grey value 72 has to be activated during the subfield 4 equal to 8 and the subfield 7 equal to 64. In the conventional method, in which the addressing for the entire picture is performed all at once, this has the disadvantage that there is a certain loss of time and, in addition, the luminous intensity levels of the individual cells are not very constant, since a relatively large amount of time is needed for the overall display of an entire picture, as a result of the overall addressing of the picture.

In addition to the method of the overall addressing of the picture and its subdivision into subfields, the method is also known in which addressing is carried out line by line, and each line is subdivided into 8 subfields in the case of 256 grey stages. In this case, it is also disadvantageous that time losses occur during the addressing and the activation of the cells.

SUMMARY OF THE INVENTION

The invention is based on the object of compensating for these time losses and of achieving an enhanced picture display. This object is achieved by the features of the invention specified in the claims. Advantageous developments of the invention are specified in the subclaims.

The method according to the invention for driving a plasma screen which is subdivided into horizontal lines and vertical pixel points, it being possible for the individual pixel points to be driven for different lengths of time, and a preparation mode and an addressing mode being provided for driving, is distinguished by the fact that the lines are combined into groups and in that, in the groups, a preparation mode and the addressing mode are executed separately, the preparation mode comprising a priming mode and an erasing mode.

This separation of the priming mode and addressing mode makes it possible to operate with the respectively optimal voltages. The priming mode is a ionization step which is necessary to insure a good firing of each cell. In the known methods, operations are carried out with an integrated circuit which executes both the priming mode and the addressing mode. In the method according to the invention, this is deliberately separated, in order that the circuit for the addressing can be supplied with a low voltage and the circuit for the preparation mode can be supplied with a higher voltage consequently needed. The separate circuits could be constructed as integrated circuits but could also be constructed discretely, so that, for example, an integrated circuit is used for the addressing, but a discrete circuit is used for the preparation mode. As a result of combining the lines into groups, it becomes possible for the system to execute the build-up of a screen more quickly, so that so-called picture flickering is improved and may even be dispensed with entirely.

Preferably, the preparation mode and the addressing mode will begin with an offset from line to line.

The fact that the preparation mode and addressing mode are offset from line to line means that the pixels are driven cyclically one after another, and the offset means that the picture as such is built up more uniformly.

In addition, in the groups, the preparation mode and addressing mode are subdivided into cycles.

The fact that, in the groups, the preparation mode and addressing mode are subdivided into identical cycles means that, on the one hand, in the groups the cycles can be executed in parallel and, on the other hand, as a result the picture will again appear to be more uniform.

Furthermore, the preparation mode comprises an extinguishing mode and/or a low-drive mode.

The preparation mode as such can be designed as an extinguishing mode, by the respective pixel point or the respective plasma cell being made dark, but can also be used to bring about low driving of the plasma cell. This low driving has the advantage that the plasma cell experiences better firing. After the plasma cell or the pixel has been ionized and then erased during the preparation mode, it can subsequently be addressed and then activated or not activated.

In the groups, the preparation mode and the addressing mode are executed separately.

Separate execution in the groups between preparation and addressing modes makes it possible for the complete groups to be ionized and erased and subsequently complete addressing of the groups to be carried out. It would thus be possible for discrete circuits to be used deliberately to extinguish all the lines or drive them low or, respectively, first to extinguish them and then to drive them low, and then for the individual lines to be addressed subsequently.

Furthermore, there is the possibility that in the method, in all the groups, the preparation mode and the addressing mode are executed synchronously.

Synchronous execution in all the groups would have the advantage that a simplification in circuit terms could be used, since the respective lines in the individual groups could be driven synchronously. A synchronous driving could lead to a further enhancement of the picture, the driving as such becoming somewhat more complicated. As a result of the respectively synchronous driving of the identical lines in the groups, a simplification would again occur, since the individual cycles in the individual groups are to be viewed in parallel.

Furthermore, in all the groups, the respective identical lines execute the preparation mode and the addressing mode synchronously.

BRIEF DESCRIPTION OF THE DRAWINGS

The invention will be explained below using a number of exemplary embodiments and with reference to the drawing, in which.

DESCRIPTION OF THE PREFERRED EMBODIMENTS

Figure 1:
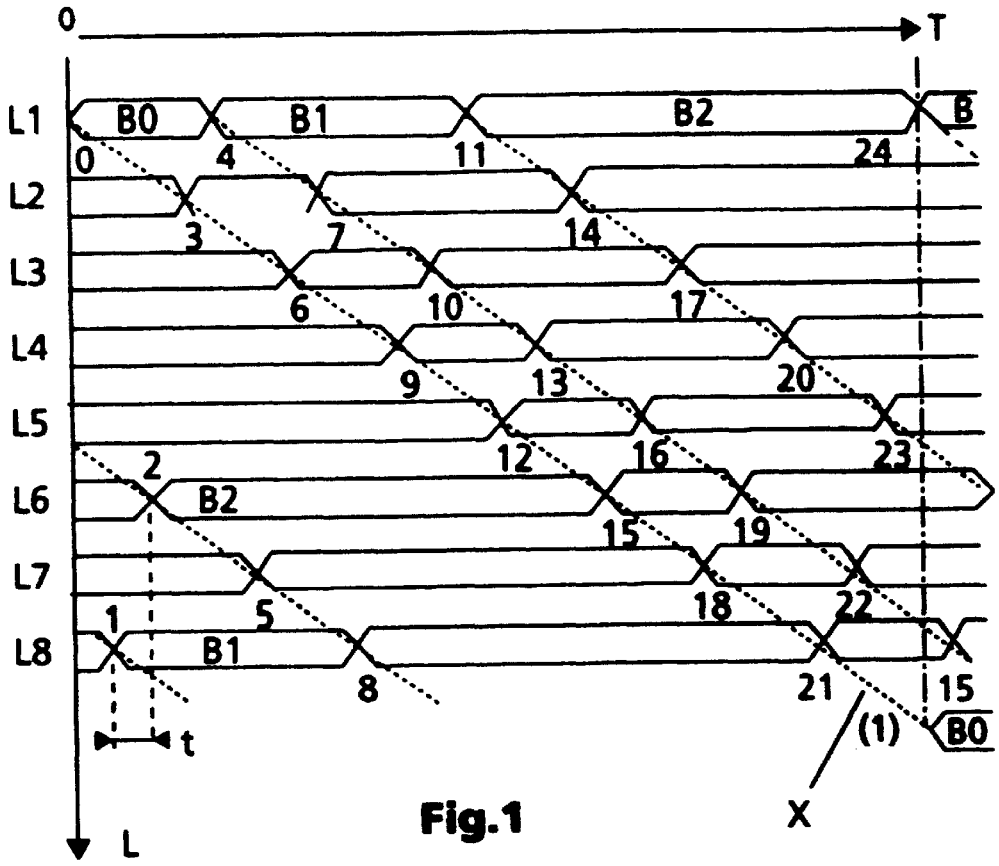
FIG. 1 shows a known line driving method.

FIG. 1 shows a known line driving method. In order to display a cell, that is to say therefore a pixel point, with different brightness on a plasma screen, the said pixel point must be driven for different lengths of time. In the example represented in FIG. 1, it is possible to di a pixel point or the respective pixel points in one line, here in eight different grey stages, in the time range of T=20 ms. For this purpose, the driving time is subdivided into 3 subfields, referred to below as regions. The regions B0, B1 and B2 represented constitute the length of time for which a plasma cell illuminates. Shortly before this time period B0, B1 and B2, the addressing is performed in order that the plasma cell can subsequently be fired. If, for example, a pixel point in line 1 is to receive the grey value 2, then at the end of the phase B0 the cell or the pixel point is addressed, so that at the end of the phase B0, at the time 4, the appropriate pixel point is fired and illuminates during the entire time duration 2T/7, that is to say during the time period B1.

The eight different grey stages are achieved in that $2^3$ is taken, since it is a digital system, so that the result is the regions 1T, 2T and 4T. Depending on the way in which these regions are combined, it is possible for eight different grey stages to be obtained, with grey stages 0 to 7. If, therefore, the maximum illuminating power is to be produced, the pixel point illuminates during the whole of the 20 ms; given minimal drive the pixel point will not illuminate at all. Given an appropriate numeric drive method, as in the example described above, drive is applied during individual regions or during combined regions of the pixel point, so that it illuminates. If, for example, a grey value of 5 is to be achieved, the pixel point illuminates during the time region 1T/7 and during the time region 4T/7. Driving is carried out accordingly earlier. If the pixel point is located at the beginning of a line, then a pre-addressing time is provided there by the system or, at the end of the line, the first pixel point of the line then to be rewritten is addressed.

In the case of lines 1–8, the regions B0, B1 and B2 are arranged to be offset in time. The system then executes the individual times 1–24 one after another. At the time 0, a beginning is made in line 1, before the region B0, at the time 1 a beginning is made in line 8, before the region B1, at the time 2 a beginning is made in line 6, before the region B2. At the time 3, a beginning is made in line 2, before the region B0, at the time 4 one is again in line 1, before the region B1. This means that the system needs to execute the line 1 again only after four steps.

Figure 2:
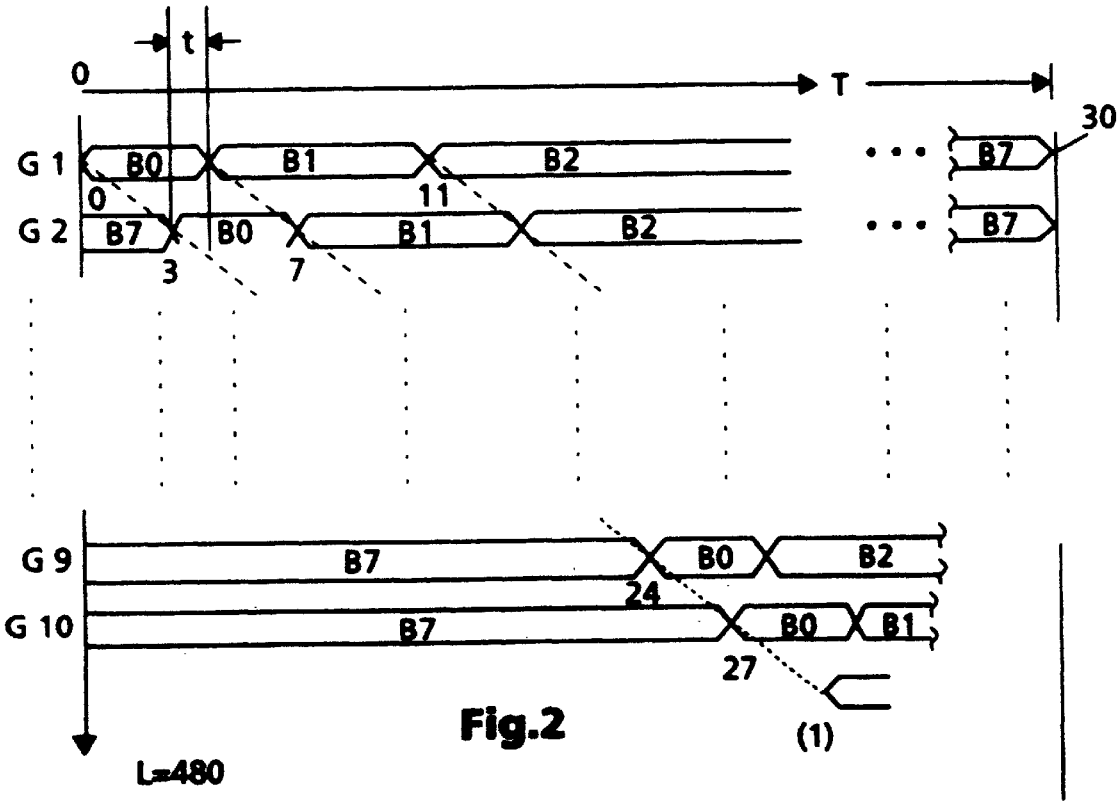
FIG. 2 shows a driving method according to the invention for a number of groups.

FIG. 2 shows a line driving method or a number of groups. In the case of a television screen having 480 lines, these are subdivided into ten groups G1–G10 each having 48 lines. In order to display the 256 different grey stages, the regions B0–B7 would be available, so that, on a binary counting basis, 256 different drive possibilities would be available, as has already been described in FIG. 1 with 8 grey stages. The different groups G1–G10 illustrated in FIG. 2 are formed from the respectively identical lines. This means that the preparation mode and the addressing mode in each case takes place at the same time in identical lines. The addressing of the individual pixels for each line is in each case performed in the regions B0–B7.

If the line x in FIG. 1 is considered, it is possible to see that the sequence of numbers 0, 3, 6, 9 to 21 results from the selected time t on the line x. Since, in the groups G1–G10, the respective identical lines have been combined, the sequence of numbers 0, 3, 6, 9 to 27 results at the identical time t. This means that, in the group G1, the time 30 would be at the end of the group G1. If the individual groups G1–G10 and the respective regions B0–B7 are now considered, together with the corresponding times 1–30, the groups G1–G10 are executed one after another. In the groups, the preparation mode and the addressing mode are executed separately. In the regions B0–B7, the addressing and then the preparation mode are in each case carried out at the end. The addressing mode needs a lower voltage than the preparation mode. For this reason, a discrete series circuit is provided for the preparation mode, and an integrated circuit is provided for the addressing mode. Because of the separation, the integrated circuit can then operate with a lower operating voltage. The preparation mode can operate with favourable components and higher voltages, because of the discrete construction. The fact that the preparation mode is carried out simultaneously in all the pixels of one line, it is possible to drive identical lines in the individual groups synchronously. In this way, it is possible to imagine that the entire system is executed in the manner of a grid, and as a result clearly and in a manner which gains time.

Figure 3:
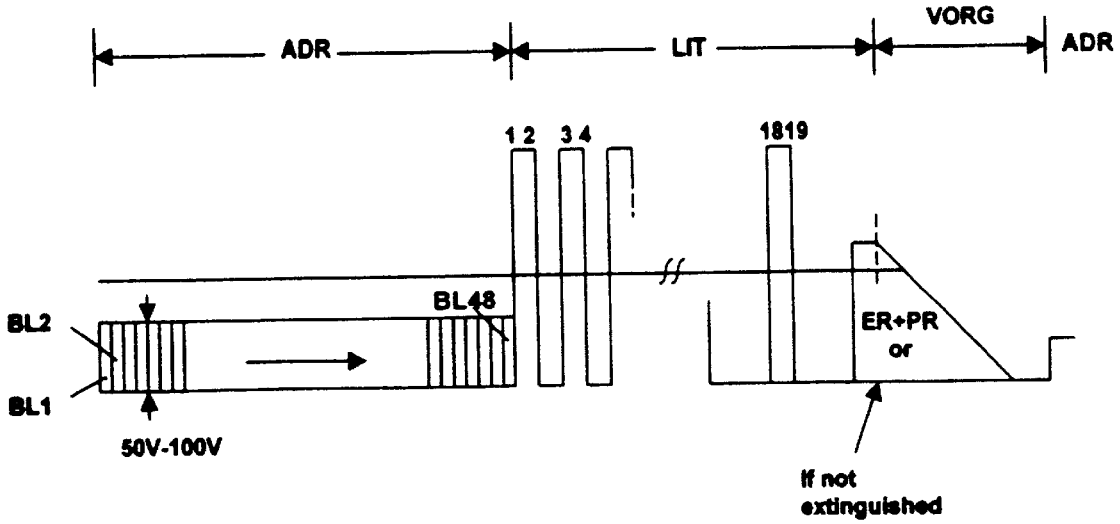
FIG. 3 represents the addressing mode and preparation mode.

FIG. 3 shows the addressing and preparation mode. After the addressing mode ADR, the plasma cell is fired LIT, and an extinguishing operation ER and/or a minimal drive PR can then be performed, so that the next addressing can be carried out. The extinguishing operation ER and/or the minimal-drive operation PR can preferably be combined. This is represented here. If a pixel does not have to be made dark, this is also not extinguished. Minimal drive is helpful if a pixel has been made dark or has been extinguished, in order that it subsequently fires better. The addressing regions BL1–BL48 are provided for addressing the 48 lines in the groups G1–G10 in the addressing mode ADR.

Figure 4:
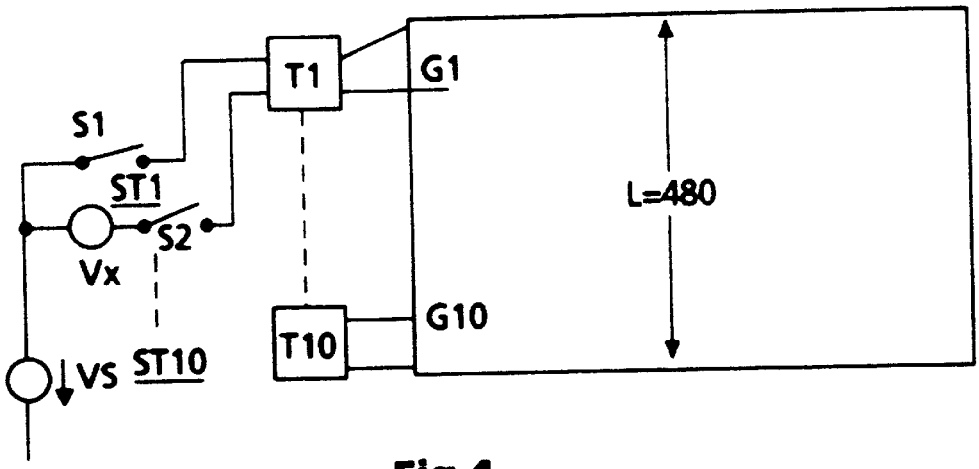
FIG. 4 shows the driving of a plasma screen in schematic form.

FIG. 4 shows the driving of the plasma screen in schematic form. The supply voltage VS is supplied to the extinguishing/minimal-drive generator VX. The integrated circuits of the drivers are represent as T1–T10 and pass on the appropriate information to the groups G1–G10. If the switch S1 is opened and the switch S2 is closed, the voltage of the extinguishing/minimal-drive generator is passed on via the driver to the individual plasma cells in the lines, so that extinguishing or minimal driving is carried out. This is the preparation mode VORB previously mentioned. If the switch S1 is closed and the switch S2 is opened, the addressing mode is carried out. As illustrated dashed on the left-hand side of FIG. 4, the extinguishing/minimal-drive generator VX can also be arranged separately.

What is claimed is:

1. Method of driving a plasma screen which is subdivided into horizontal lines and vertical pixel points, it being possible for the individual pixel points to be driven for different lengths of time, a preparation mode and an addressing mode being provided for driving, wherein the lines are combined into a plurality of groups and in that, in the plurality of groups, a preparation mode and the addressing mode are executed separately, the preparation mode comprising a priming mode and an erasing mode, and wherein the preparation mode and the addressing mode for each of the plurality of groups of lines are executed one after another.

2. Method according to claim 1, wherein the preparation mode is executed first and then the addressing mode.

3. Method according to claim 1, wherein the preparation mode and the addressing mode begin with an offset from line to line.

4. Method according to claim 1, wherein, in the groups, the preparation mode and the addressing mode are subdivided into cycles.

5. Method according to claim 1, wherein, during the preparation mode, an extinguishing mode and/or a low-driving mode are carried out.

6. Method according to claim 1, wherein, in all the groups, the preparation mode and the addressing mode are executed synchronously.

7. Method according to claim 1, wherein, in all the groups, the preparation mode and the addressing mode are executed synchronously in the respective identical lines.

8. A method for driving a plasma display panel including a plurality of horizontal pixel lines, comprising the steps of:

executing a preparation mode and an addressing mode for a first group of horizontal pixel lines; and, executing a preparation mode and an addressing mode for a second group of horizontal pixel lines different from said first group, wherein said execution of said preparation mode and addressing mode for said first group of horizontal pixel lines takes places before said preparation mode and addressing mode for said second group of horizontal pixel lines.

9. The method of claim 8, wherein the preparation mode and the addressing mode for the first group of horizontal pixel lines are executed separately.

10. The method of claim 8, wherein the preparation mode and the addressing mode for the second group of horizontal pixel lines are executed separately.

11. The method of claim 8, wherein the preparation mode for the first and second groups of horizontal pixels comprises a priming mode and an erasing mode.

12. A method for driving a plasma display panel including a plurality of horizontal pixel lines, comprising the steps of:

grouping horizontal lines of pixels of the plasma display panel into a plurality of distinct groups;

executing a preparation mode and an addressing mode for a first group of horizontal pixel lines of the plurality of distinct groups; and, executing a preparation mode and an addressing mode for a second group of horizontal pixel lines of the plurality of distinct groups different from said first group, wherein said execution of said preparation mode and addressing mode for said first group of horizontal pixel lines takes places before said preparation mode and addressing mode for said second group of horizontal pixel lines.

* * * * *